US006094801A

United States Patent [19]

Howe

[11] Patent Number: 6,094,801

[45] Date of Patent: Aug. 1, 2000

[54] INTERLOCKING TENT CLIPS FOR QUICK SETUP

[76] Inventor: Robert H. Howe, 1125 Foxwood Pl., Bend, Oreg. 97701

[21] Appl. No.: 09/160,451

[22] Filed: Sep. 24, 1998

[51] Int. Cl.[7] ..... B23P 11/00

[52] U.S. Cl. ..... 29/525.01; 24/370; 24/369; 135/115; 135/119; 403/326; 403/329; 29/426.6; 29/423

[58] Field of Search ..... 403/329, 326; 29/453, 426.6; 238/378; 24/369, 370, 265 H, 598.4, 579.1, 598.5; 135/119, 115, 90, 121

[56] References Cited

U.S. PATENT DOCUMENTS

| | | | |
|---|---|---|---|
| 1,643,183 | 9/1927 | Smith . | |
| 1,690,694 | 11/1928 | Nissen . | |
| 4,193,413 | 3/1980 | Watts et al. | 135/2 |
| 4,315,351 | 2/1982 | Bartolini | 24/198 |
| 5,002,083 | 3/1991 | Kim | 135/98 |
| 5,421,355 | 6/1995 | Cantwell | 135/120.3 |
| 5,678,953 | 10/1997 | Usui | 403/329 |

FOREIGN PATENT DOCUMENTS

| | | | |
|---|---|---|---|
| 2547909 | 5/1977 | Germany | 24/370 |
| 3213781 | 2/1983 | Germany | 135/115 |

*Primary Examiner*—S. Thomas Hughes
*Assistant Examiner*—Anthony L. Green
*Attorney, Agent, or Firm*—David Pressman

[57] ABSTRACT

A tent clip design for coupling with similar adjacent clips comprises a C-shaped upper portion (11) that can be snapped onto a tent pole (12), a webbing slot (19) at the bottom for attaching a loop of webbing (20) extending up from the tent (21) below, a laterally extending tongue (14) with a toothed lower surface (15) near its distal end, and a corresponding tongue slot (16) immediately below the tongue with a toothed upper surface (17) on its lower edge to join in locked engagement with the toothed lower surface (35) of tongue (34) of a similar adjacent tent clip (30) when two or more similar clips are aligned and pressed together. The portion of the clip below the tongue slot is made of flexible material and comprises flexible portion (18) of the clip. A user of the clip can interlock the clip with similar adjacent clips into clusters which can be far more rapidly mounted than can the same number of separated clips, and with considerably less likelihood of being attached in the wrong sequence or orientation, or attached to the wrong pole. Once the clusters are mounted on the poles, a user of the clips can pull down on loops of webbing (20) residing in webbing slots (19) to temporarily widen tongue slots (16) and axially release any toothed tongues held within the tongue slots. The user can thus disengage interlocked clips individually or may disengage them in groups by pulling simultaneously on their webbing or on the attached tent fabric. Thus the tent clip considerably simplifies and expedites the otherwise tedious process of connecting tent clips to overlying support poles. This will greatly reduce the exposure of mountaineers, particularly less experienced mountaineers, to the extreme weather conditions commonly prevailing when tents are erected at high altitudes.

20 Claims, 3 Drawing Sheets

INTERLOCKING TENT CLIPS FOR QUICK SETUP

BACKGROUND

1. Field of the Invention

This invention relates to tent clips, specifically to easier-to-use tent clips for attaching tent fabric to an overlying pole.

2. Prior Art

Tents are supplied with their component parts disassembled and packaged. The parts must be unpacked and assembled to erect the tent. Reducing the time required to erect a tent properly may be more than a convenience. In high-altitude, extreme conditions, tent setup can test the patience of even highly experienced alpinists. For the less experienced, simplifying and hastening this process may become a matter of survival.

Many tents used by backpackers and mountaineers employ a series of clips to attach the tent fabric or body to overlying support poles. Such tents usually have from one to six flexible poles, which arch over the body of the tent, with each pole end being attached to the perimeter of the tent fabric. A series of tent clips, each attached to the tent fabric by a strap or piece of webbing, are then attached to the pole in order to support the tent body and to hold the pole in correct alignment. A typical tent may have twenty or more of these clips. Attaching the clips to the support poles is frequently the most time-consuming step in setting up a tent. To attach each clip individually requires considerable time. However, to ensure proper attachment, each clip must be correctly aligned, positioned, and then somehow held in this arrangement prior to attachment to the overlying poles. This is not a simple or a quick process to perform, particularly in extreme weather conditions. If any of the above steps are omitted, or hastily performed, it is likely that some clips will be attached in the wrong orientation and sequence, and frequently to the wrong poles. Thus, further setup time is often required to detach and then reattach errant clips. Ways of expediting this tedious tent setup process are understandably in great demand by tent users and manufacturers.

U.S. Pat. No. 1,643,183 to Smith (1927) and U.S. Pat. No. 1,690,694 to Nissen (1928) show clips which connect on one side to a cord or webbing, while U.S. Pat. No. 4,315,351 to Bartolini (1982) shows a clip that attaches directly to fabric by ultrasonically welding a protruding polymeric tab into the fabric. While these clips do have means that would allow them to be attached to webbing or fabric, no means of simplifying or expediting the process of attaching tent clips to tent poles is shown or suggested.

U.S. Pat. No. 4,193,413 to Watts et al. (1980) shows a means for releasably attaching fabric to an overlying pole, as does U.S. Pat. No. 5,002,083 to Kim (1991) and U.S. Pat. No. 5,421,355 to Cantwell (1995). However none of these patents suggest or show any way to expedite tent clip placement.

In conclusion, no tent clip formerly developed or known addresses or meets the need for systematically organizing and expediting the process of connecting tent clips to tent support poles.

OBJECTS AND ADVANTAGES

Accordingly, several objects and advantages of the invention are to provide an improved tent clip, to provide means of expediting tent setup, and to provide a swifter, more user-friendly, yet economical, means of attaching tent fabric to tent poles. Further objects are to provide means of releasably interlocking adjacent tent clips, and to provide means of releasing interlocked tent clips that may be quickly and easily activated. Still further objects and advantages will become apparent from a study of the following description and the accompanying drawings.

DRAWINGS

Reference Numerals

Figure 1:
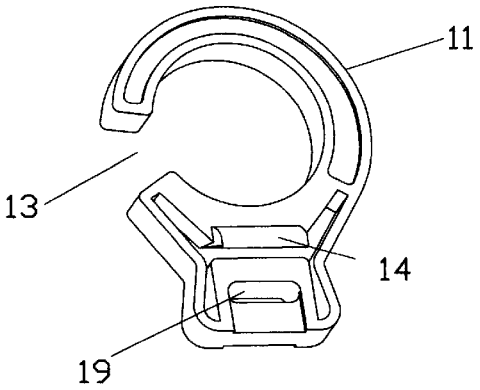
FIG. 1 is a front view of a quick setup tent clip constructed in accordance with the invention.

| | |
|---|---|
| 10 Quick setup tent clip | 21 Tent |
| 11 Upper portion of clip | 22 Tent base pole support |
| 12 Tent pole | 23 Grommet |
| 13 Tent clip pole gap | 30 Quick setup tent clip adjacent clip 10 |
| 14 Tongue | 31 Upper portion of quick setup tent clip |
| 15 Toothed lower surface of tongue 14 | 34 Tongue (of tent clip 30) |
| 16 Tongue slot | 35 Toothed lower surface of tongue 34 |
| 17 Toothed upper surface of slot 16 | 36 Tongue slot of clip 30 |
| 18 Flexible portion of tent clip | 37 Toothed upper surface of slot 36 |
| 19 Webbing slot | 38 Flexible portion of clip 30 |
| 20 Webbing | 39 Webbing slot of clip 30 |

SUMMARY

In accordance with the invention, an improved tent clip for attaching a tent pole to tent fabric comprises a C-shaped upper portion which can be snapped onto the pole, a webbing slot at the bottom for attaching a loop of webbing extending up from the tent below, a laterally extending tongue with a toothed lower surface near its distal end, and a corresponding tongue slot immediately below the tongue with a toothed upper surface on its lower edge to join in locked engagement with the toothed lower surface of the tongue of a similar adjacent tent clip when two or more similar clips are aligned and pressed together. The material comprising the lower side of the tongue slot and the other material surrounding the webbing slot is flexible so that pulling down on a loop of webbing residing in the webbing slot will temporarily widen the tongue slot and will axially release any toothed tongue held within the tongue slot. Interlocked clips may be thus disengaged individually or in groups by pulling simultaneously on their webbing or on the attached tent fabric.

Description—FIG. 1—Front View

FIG. 1 is a front view of a molded plastic quick setup tent clip 10 constructed in accordance with the invention. The clip comprises a body which has a C-shaped upper connector or portion 11 that forms a tent pole gap 13. The clip is preferably made of a flexible or deformable plastic material, such as nylon, and is about 70 cm high, 5 cm thick, and 8 cm wide, with other parts scaled proportionately. The C-shaped upper portion is generally circular and gap 13 subtends about 40 degrees of the circle. A tongue 14 extends down and out about 5 cm from the clip and is visible above a webbing slot 19.

Figure 2:
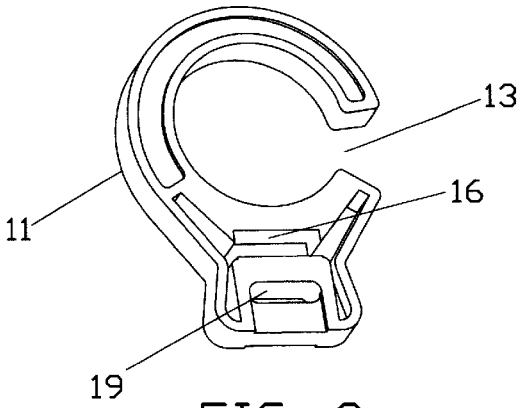
FIG. 2 is a rear view of the tent clip of FIG. 1.

Description—FIG. 2—Rear View

FIG. 2 is a rear view of the clip 10, showing a tongue-receiving slot 16 above webbing slot 19. Slot 16 (FIG. 3) is behind and is bordered on its top side by the underside of tongue 14. Tongue 14 and slot 16 comprise a side interconnector for connecting adjacent clips, as will be described.

Figure 3:
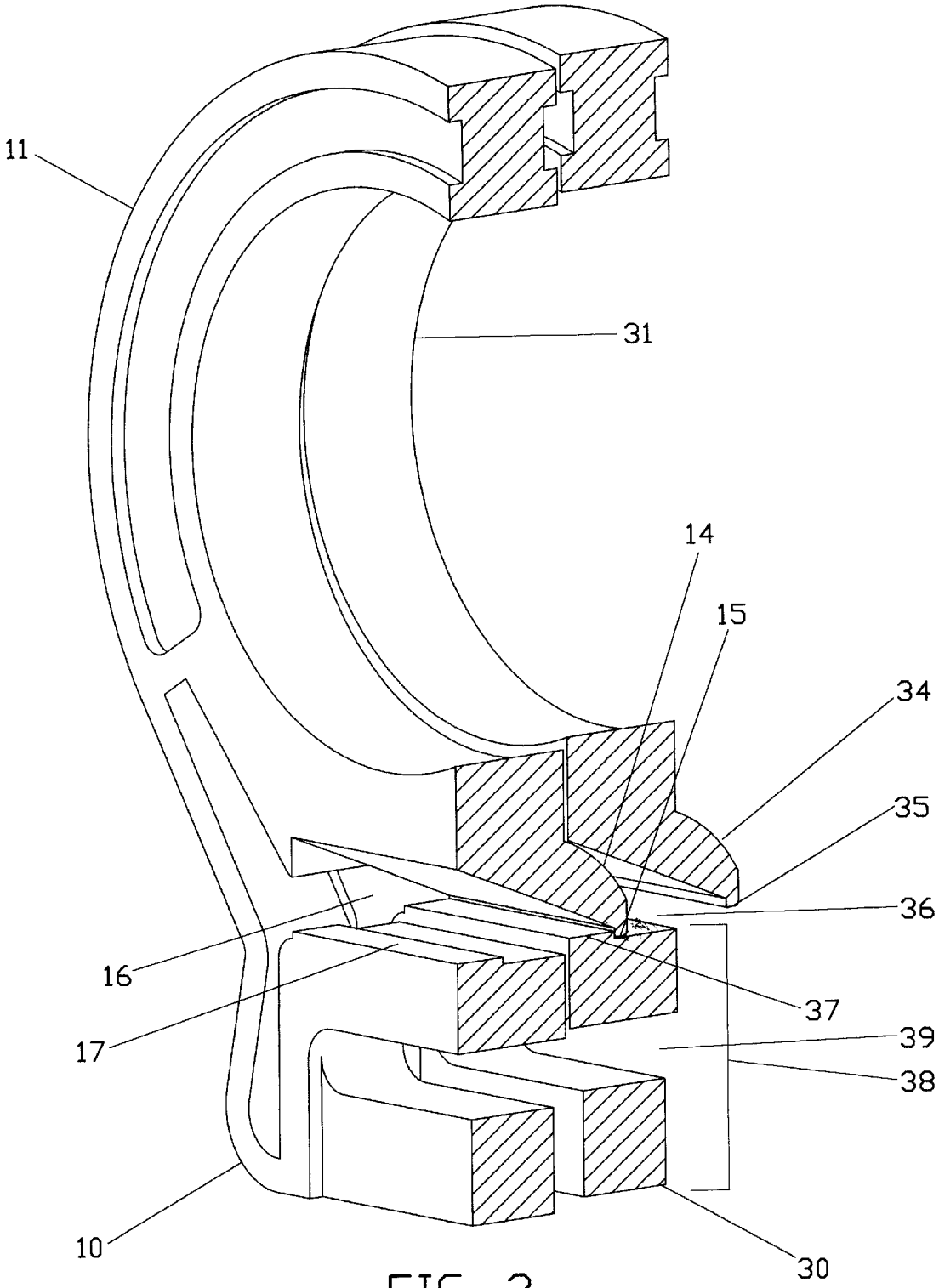
FIG. 3 is a rear oblique cross-sectional view of two identical tent clips as shown in FIGS. 1 and 2, wherein one clip has been aligned with the other and pressed into interlocking contact therewith.

Description—FIG. 3—Cross Section

FIG. 3 is a rear oblique cross section through two identical clips 10 and 30 that have been aligned and pressed into interlocking contact. Tongue 14 of clip 10, on the left, has been pressed into tongue slot 36 of clip 30, on the right. That is, when the two clips are pressed together, tongue 14 of clip 10 is pressed into tongue slot 36 of clip 30 such that the lower surface 15 of tongue 14 of clip 10, which is toothed, engages and locks onto upper surface 37 of the lower edge of tongue slot 36 of clip 30, which is also toothed.

The two clips are held thusly together until flexible portion 38 of clip 30 is deformed downward. This widens tongue slot 36 of clip 30 so that toothed lower tongue surface 15 of clip 10 disengages from toothed upper surface 37 of the lower edge of tongue slot 36 of clip 30. This allows clips 10 and 30 to separate axially. The downward pull on flexible portion 38 of clip 30 can easily be supplied when desired by pulling downward on a piece of webbing (not shown in this figure) which is looped through webbing slot 39.

Figure 4:
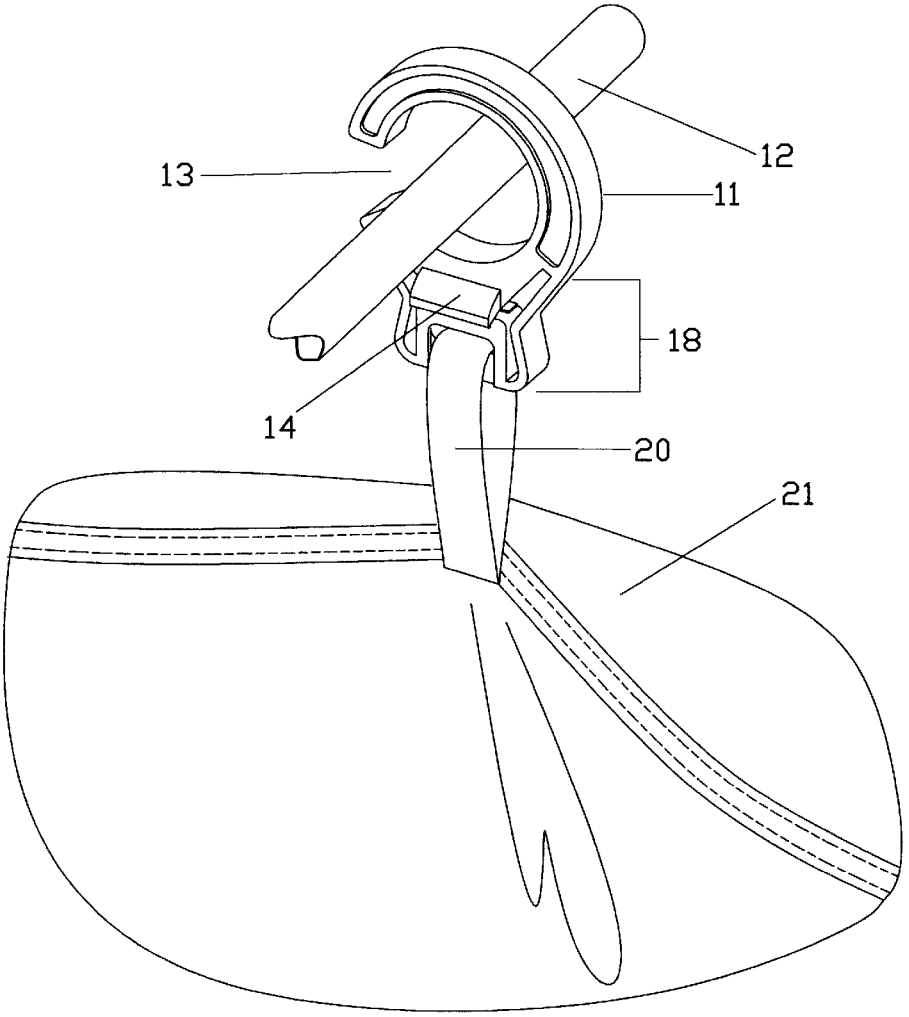
FIG. 4 is a front oblique view of the tent clip of FIGS. 1, 2, and 3, with the clip shown hanging from a tent pole and supporting a length of webbing attached to a fabric tent.

Description—FIG. 4—Front Oblique View

FIG. 4 is a front oblique view of tent clip 10 hanging from a tent pole 12 after gap 13 of clip 10 is snapped over pole 12. A snap fit is created here because gap 13 is just slightly smaller than the outside diameter of pole 12. As shown, the diameter of the opening or lumen of the clip is substantially larger than the diameter of pole 12 so that the clips can slide freely on the pole. Tongue 14 is visible above the flexible portion 18 of the clip. Webbing 20, sewn to fabric tent 21, is looped through webbing slot 19. If a downward pull is exerted on webbing 20, and thus on flexible portion 18, deformation of flexible portion 18 will occur, as was described above in the description of FIG. 3.

Figure 5:
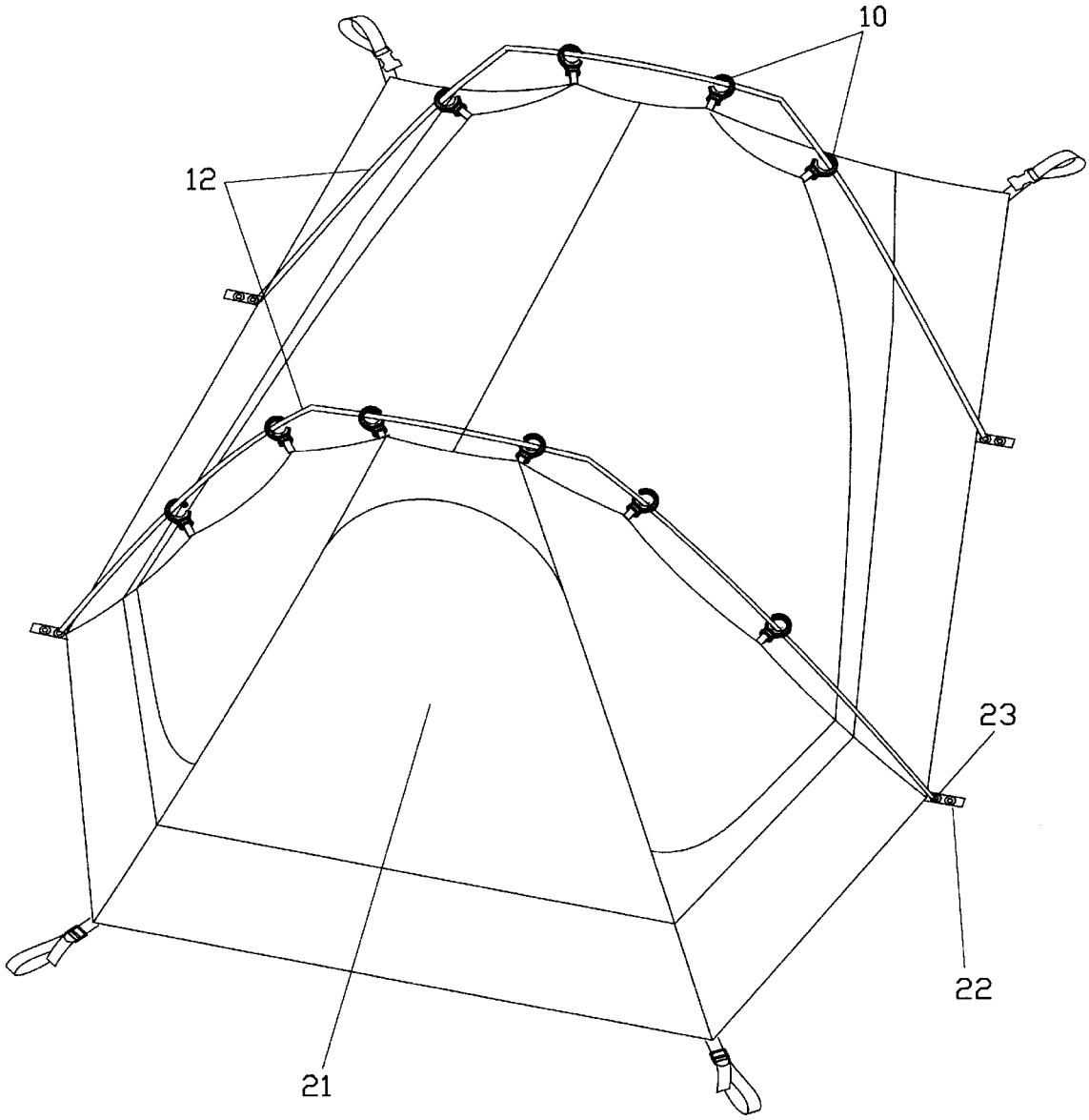
FIG. 5 is a front oblique view of a fabric tent connected to overlying tent poles by quick setup tent clips constructed in accordance with the invention.

Description—FIG. 5—Front View

FIG. 5 is a front oblique view of a fabric tent 21 connected to two overlying tent poles 12 by quick setup tent clips 10. A tent base pole support (or restraint) 22, made of webbing or a strap (preferably nylon) is sewn to the main body of the tent. Each tent base pole support 22 has a grommet 23 through which the end of tent pole 12 is inserted during the process of setting up the tent. Locking pole tips may be used, if desired, at the ends of the poles to more securely connect the pole ends to the tent base pole supports.

OPERATION

The manufacturer will initially supply the tent with the clips attached to the tent body but not to the poles. The manufacturer may or may not supply the tent with the clips clustered initially to aid in the first setup of the tent.

If the clips are not clustered initially, the user will need to attach them individually to the poles for the first usage or tent setup. The individual clips are attached to the pole by snapping gaps 13 of C-shaped upper portions 11 over the pole in sequence, or by inserting the pole in sequence through the aligned lumens or openings of upper portions 11 of the clips. Once the clips are attached to the poles in the correct order and orientation (at their first usage) they will no longer require individual attachment for subsequent setups.

If the clips are clustered initially, each cluster is joined to its pole by snapping all clips in the cluster over the pole, or by inserting the pole through the aligned lumens of upper portions 11 of the cluster.

After the clips are attached to the poles and the tent is set up in the normal manner, it will appear as in FIG. 5. That is, the main body of the tent fabric will be suspended from the poles by the clips and the ends of the poles will be held or restrained by supports 22.

To strike, or take the tent down, the clips are pressed together in clusters while still attached to the pole, in preparation for the next setup of the tent. The clips may be pressed and locked or snapped together into clusters while on the pole by aligning all the clips to be clustered and then pressing them against a locked pole tip on one end of the pole. This is done by pushing the clip furthest from the locked pole tip towards the locked pole tip, with the clips facing in the same direction. The user then compresses the cluster axially such that tongue 14 of each clip in the cluster enters tongue slot 16 of the adjoining clip (FIGS. 1, 2, 3, and 4). The user presses with enough force to snap each toothed lower tongue surface 15 of each clip into locking engagement with the corresponding toothed lower edge 17 of tongue slot 16 of each adjacent clip. This will interlock the clips of the cluster. Since the clips are attached to the tent, clustering the clips will also crumple or compress the tent fabric (not shown). Normally two to six clips will be pressed together for each cluster and there will be one cluster for each pole.

Once the clips are pressed together into clusters, the pole tips are disconnected from tent base pole supports 22 and the clip cluster is slid off each pole. After the tent is thus taken down it will be further compressed and put into a stuff sack for carrying. The poles are also collapsed for transport.

Succeeding tent setups are considerably easier and faster than the first setup. With the clip clusters for each pole already formed, each cluster may be snapped over its corresponding pole, via aligned gaps 13. Each pole end is then inserted into grommet 23 (FIG. 5) of tent base pole support 22. Alternatively the pole may be inserted into aligned lumens of upper portions 11.

The user can then axially release the interlocked clips easily, rapidly, and automatically by simply pulling webbing 20 attached to each clip, either one at a time or in groups. This pull will temporarily deform flexible portions 18 of the clips and enlarge tongue slots 16 to allow an axial release of toothed tongues 14 held within slots 16. Thus, the joined clips will separate from each other axially and will assume positions along the pole according to the spacing of webbing straps 20 (FIG. 5).

To strike the tent again, the clips are first reclustered as before, the poles are detached from their restraints 22, the clusters are slid off the poles, and the tent and poles are repacked.

CONCLUSION, RAMIFICATIONS, AND SCOPE

The reader will see that I have provided an improved tent clip that can be produced economically and that will greatly simplify and expedite tent setup. Tent clips can be quickly snapped together in clusters to allow the clips to be mounted onto their support poles in groups rather than individually, greatly expediting the mounting process and greatly reducing the likelihood of some clips not being mounted, or being mounted in the wrong sequence or the wrong orientation, or mounted to the wrong poles. The ease of disconnecting the interlocked clips—with a simple tug—also saves time and effort, especially critical in extreme weather conditions.

While the above description contains many specificities, these should not be construed as limitations on the scope of the invention, but as exemplifications of the presently preferred embodiments. Many other ramifications and variations are possible within the scope of the invention. For example, side-release plastic buckle technology or other push-button release mechanisms can be applied to the means of release of the interlocked tongue from the tongue slot. More teeth, or differently-shaped teeth, can be added to the interlocking means. The clip can be adapted to connect to poles that are not overhead, or not to poles, but rather to ropes or webbing. The upper end of the clip can be changed from a C-shaped hook with a side opening to a hook in the shape of an upside-down U, with the opening at the lower end. Or the clip can be a closed ring without any opening. Flexible "keepers" can be added just inside the tent clip pole gaps to prevent disengagement of the clip in extremely high winds. The clip can be made to swivel for greater stability. A means for gripping the pole can be added to the clip, and also means for connecting the clips on one pole to clips on an adjacent pole may be provided. Other means of connecting the clips together in clusters can be used, such as using a cord to draw the clips together. The tongue and tongue slot may each be toothed on two sides rather than on only one side. The clips can be made of metal, wood, or any other slightly flexible material. The tongue may be hooked or may have a triangular, rounded, or elliptical cross section. The clips may be attached to the tent by cords that extend up from the tent below and are looped through holes in the clips. The clips may have arms that are barbed or pointed for insertion into a pocket or seam on the tent. The clips may have molded pierceable thin sections attached that are designed to be sewn directly to the tent.

Thus, the scope of the invention should be determined by the appended claims and their legal equivalents, and not by the examples given.

What is claimed is:

1. A method for attaching a tent to a support pole comprising:

a. providing a plurality of tent clips whose bottom ends are attached to said tent at spaced locations thereon, b. detachably joining together said plurality of tent clips to form a cluster, and c. mounting said cluster singly, as a group, onto said pole, and d. detaching said tent clips from each other, whereby said clips facilitate the rapid attachment of said tent to said pole.

2. The method of claim 1 wherein said detachably joining together said plurality of tent clips to form a cluster comprises:

a. providing each clip with a laterally extending tongue having a toothed bottom surface on its distal end and a corresponding tongue slot located immediately below said tongue and toothed on the upper surface of its lower side for receiving and locking onto the toothed tongue of a similar adjacent tent clip, and b. inserting said tongue into the tongue slot of a similar adjacent clip, and c. compressing said clips axially into detachable engagement.

3. The method of claim 1 wherein said detaching said tent clips from each other comprises:

a. providing a plurality of tent clips wherein said lower sides of said tongue slots and the portion of said tent clips below said tongue slots are comprised of flexible material and comprise a flexible portion of each of said tent clips, and b. widening said tongue slots by pulling downward on said bottom ends of said tent clips, whereby a toothed tongue of a similar adjacent tent clip locked into engagement with said toothed upper surface of said lower side of said tongue slot may thereby be released from engagement therewith.

4. The method of claim 1 wherein the method of attaching said bottom ends of said plurality of said tent clips to said tent comprises:

a. providing each of said bottom ends of said tent clips with a slot for receiving a loop of webbing connected to said tent, and b. connecting a piece of webbing to said tent proximate each desired tent clip location, and c. connecting said pieces of webbing to said slots.

5. The method of claim 1 wherein the method of mounting said cluster onto said pole comprises:

a. providing each of said clips with a C-shaped upper portion having a gap slightly smaller than the outside diameter of said pole such that said C-shaped portion of said tent clip will provide a snap fit when said opening is pulled onto said pole, and b. joining detachably together said plurality of tent clips with said openings aligned, and hooking said cluster, as a group, onto said pole with said openings aligned, and pulling said aligned cluster of tent clips, as a group, onto said pole.

6. The method of claim 1 wherein said detachably joining together said plurality of tent clips to form a cluster comprises:

a. providing each clip with a laterally extending tongue having a toothed bottom surface on its distal end and a corresponding tongue slot located immediately below said tongue and toothed on the upper surface of its lower side for receiving and locking onto the toothed tongue of a similar adjacent tent clip, b. inserting said tongue into the tongue slot of a similar adjacent clip, and c. compressing said clips axially into detachable engagement, and wherein the method of attaching said bottom ends of said plurality of said tent clips to said tent comprises:

d. providing each of said bottom ends of said tent clips with a slot for receiving a loop of webbing connected to said tent, e. connecting a piece of webbing to said tent proximate each desired tent clip location, and f. connecting said pieces of webbing to said slots.

7. A tent clip, comprising:

a clip body having an upper portion and a lower portion, said upper portion having a pole connector for connecting said upper portion to a tent pole of a predetermined outside diameter, said bottom portion having a tent attachment for attaching said bottom portion to a tent situated below said tent clip, said upper portion also including a side interconnector means for releasably connecting one side of said upper portion to and adjacent the opposite side of the upper portion of a similar tent clip, such that said one side of said tent clip can be releasably connected to and be held adjacent to said opposite side of said similar tent clip, whereby said tent clip and said similar adjacent tent clip may be connected together to form an assembly which can be connected as a unit to said tent pole and then said tent clip and said similar adjacent tent clip may be released and separated along said tent pole to support a tent from spaced locations on said pole.

8. The tent clip of claim 7 wherein said side interconnector means comprises an tongue extending from a side of said clip and having a toothed bottom surface on its distal end and a corresponding tongue slot located immediately below said tongue and toothed on the upper surface of its lower side for receiving and locking onto the toothed tongue of a similar adjacent tent clip.

9. The tent clip of claim 8 wherein said lower side of said tongue slot and the portion of said tent clip below said tongue slot are comprised of flexible material and comprise a flexible portion of said tent clip, whereby said tongue slot may be widened by exerting a downward pull on said attachment at the bottom of said tent clip, and whereby a toothed tongue of a similar adjacent tent clip locked into engagement with said toothed upper surface of said lower side of said tongue slot may thereby be released from engagement therewith.

10. The tent clip of claim 7 wherein said pole connector comprises a C-shaped portion of said tent clip having a gap slightly smaller than the outside diameter of said tent pole such that said C-shaped portion of said tent clip will provide a snap fit when said opening is pulled onto said pole.

11. The tent clip of claim 7 wherein said attachment at the bottom of said tent clip for attachment to a tent situated below said tent clip comprises a slot for receiving a loop of webbing connected to said tent.

12. The tent clip of claim 7 wherein said side interconnector means comprises a tongue extending from a side of said clip and having a toothed bottom surface on its distal end and a corresponding tongue slot located immediately below said tongue and toothed on the upper surface of its lower side for receiving and locking onto the toothed tongue of a similar adjacent tent clip, and wherein said pole connector comprises a C-shaped portion of said tent clip having a gap slightly smaller than the outside diameter of said tent pole such that said C-shaped portion of said tent clip will provide a snap fit when said opening is pulled onto said pole.

13. The tent clip of claim 7 wherein said pole connector comprises a C-shaped portion of said tent clip having a gap slightly smaller than the outside diameter of said tent pole such that said C-shaped portion of said tent clip will provide a snap fit when said opening is pulled onto said pole, and wherein said attachment at the bottom of said tent clip for attachment to a tent situated below said tent clip comprises a slot for receiving a loop of webbing connected to said tent.

14. A tent clip comprising:

a clip body having an upper portion and a lower portion, said upper portion having pole mounting means for connecting said tent clip to a tent pole of a predetermined outside diameter, said body having side interconnector means for releasably connecting one side of said tent clip to the opposite side of a similar adjacent tent clip, such that said one side of said tent clip can mate with the upper portion of said opposite side of said similar adjacent tent clip, and such that said one side of said tent clip can be releasably connected to and be held adjacent to said opposite side of said similar tent clip, said tent clip further comprising attachment means at the bottom of said tent clip for attachment to a tent situated below said tent clip, whereby said tent clip and said similar adjacent tent clip may be connected together to form an assembly which can be connected as a unit to said tent pole and then said tent clip and said similar adjacent tent clip may be released and separated along said tent pole to support a tent from spaced locations on said pole.

15. The tent clip of claim 14 wherein said side interconnector means comprises a tongue extending from a side of said clip and having a toothed bottom surface on its distal end and a corresponding tongue slot located immediately below said tongue and toothed on the upper surface of its lower side for receiving and locking onto the toothed tongue of a similar adjacent tent clip.

16. The tent clip of claim 15 wherein said lower side of said tongue slot and the portion of said tent clip below said tongue slot are comprised of flexible material and comprise a flexible portion of said tent clip, whereby said tongue slot may be widened by a downward pull on a loop of webbing located in said webbing slot, and whereby a toothed tongue of a similar adjacent tent clip locked into engagement with said toothed upper surface of said lower side of said tongue slot may thereby be released from engagement therewith.

17. The tent clip of claim 14 wherein said pole mounting means of said upper portion comprises a C-shaped portion having a gap slightly smaller than the outside diameter of said tent pole such that said C-shaped portion of said tent clip will provide a snap fit when said opening is pulled onto said pole.

18. The tent clip of claim 14 wherein said attachment means at the bottom of said tent clip for attachment to a tent situated below said tent clip comprises a slot for receiving a loop of webbing connected to said tent.

19. The tent clip of claim 14 wherein said side interconnector means comprises a tongue extending from a side of said clip and having a toothed bottom surface on its distal end and a corresponding tongue slot located immediately below said tongue and toothed on the upper surface of its lower side for receiving and locking onto the toothed tongue of a similar adjacent tent clip, and wherein said pole mounting means of said upper portion comprises a C-shaped portion of said tent clip having a gap slightly smaller than the outside diameter of said tent pole such that said C-shaped portion of said tent clip will provide a snap fit when said opening is pulled onto said pole.

20. The tent clip of claim 14 wherein said pole mounting means of said upper portion comprises a C-shaped portion of said tent clip having a gap slightly smaller than the outside diameter of said tent pole such that said C-shaped portion of said tent clip will provide a snap fit when said opening is pulled onto said pole, and wherein said attachment means at the bottom of said tent clip for attachment to a tent situated below said tent clip comprises a slot for receiving a loop of webbing connected to said tent.

* * * * *